US008529702B1

(12) United States Patent
Magrini et al.

(10) Patent No.: US 8,529,702 B1
(45) Date of Patent: Sep. 10, 2013

(54) CASINO CHIP CLEANING METHOD AND EQUIPMENT

(76) Inventors: Kenneth Homer Magrini, Temecula, CA (US); Kevin Martin Magrini, Temecula, CA (US)

( * ) Notice: Subject to any disclaimer, the term of this patent is extended or adjusted under 35 U.S.C. 154(b) by 342 days.

(21) Appl. No.: 12/807,420

(22) Filed: Sep. 3, 2010

Related U.S. Application Data

(60) Provisional application No. 61/281,176, filed on Nov. 13, 2009.

(51) Int. Cl.
*B08B 3/12* (2006.01)

(52) U.S. Cl.
USPC ..... 134/1; 134/25.1; 134/26

(58) Field of Classification Search
USPC ..... 134/1, 25.1, 25.4, 26, 42; 510/405, 510/509, 510
See application file for complete search history.

(56) References Cited

U.S. PATENT DOCUMENTS

| | | | | |
|---|---|---|---|---|
| 4,448,750 | A * | 5/1984 | Fuesting | 422/20 |
| 4,710,233 | A * | 12/1987 | Hohmann et al. | 205/701 |
| 5,113,881 | A | 5/1992 | Lin et al. | |
| 5,927,304 | A | 7/1999 | Wen | |
| 5,988,193 | A | 11/1999 | Hernandez | |
| 6,148,198 | A * | 11/2000 | Anderson et al. | 455/432.1 |
| 6,435,935 | B1 | 8/2002 | Komaba | |
| 2008/0257388 | A1 | 10/2008 | Purton | |

* cited by examiner

*Primary Examiner* — Saeed T Chaudhry
(74) *Attorney, Agent, or Firm* — Loyal McKinley Hanson

(57) ABSTRACT

A method for cleaning casino chips includes the step of providing a chip-cleaning system having an ultrasonic cleaning station with ultrasonic cleaning means. The method proceeds by taking a batch of chips to be cleaned out of service and cleaning the batch of chips at the ultrasonic cleaning station with the ultrasonic cleaning means. Preferably, the chip-cleaning system also includes a rinsing station, a coating station, and a drying station, and the method further comprises rinsing the batch of chips at the rinsing station, coating the batch of chips at the coating station, and drying the batch of chips at the drying station. A preferred chip-cleaning system includes a console with four tanks providing the above features, together with two foldable table-top extensions providing a chip staging area wing and a chip re-stacking area wing, and a counterbalancing arm for assisting an operator move the batch of chips between stations.

1 Claim, 10 Drawing Sheets

CASINO CHIP CLEANING METHOD AND EQUIPMENT

CROSS REFERENCE TO RELATED APPLICATION

This application claims the benefit of U.S. Provisional Patent Application Ser. No. 61/281,176 filed Nov. 13, 2009.

BACKGROUND OF THE INVENTION

1. Technical Field

This invention relates generally to the field of gaming equipment, and more particularly to a casino chip cleaning method and associated equipment.

2. Description of Related Art

Casino chips (also known as gaming chips, tokens, checks, and cheques) are an integral part of the casino environment. They are small discs used in lieu of currency, usually taking the form of compression-molded discs that are colored and marked with casino-specific graphics to represent various currency denominations. They are more convenient to use than currency and consumers seem to gamble more freely with casino chips than with cash. The uniform size and regularity of stacks of chips make them easier to count when used on a table compared to paper currency. The pit boss or security can quickly verify the amount being paid. The uniform weight of the casino's official tokens allows them to weigh large stacks or piles of chips rather than counting them, although counting aids such as chip trays are common, and some chips contain embedded electronic security devices to deter fraud.

Casino chips are handled daily by many people who rub them continuously over soiled tabletops. Hands and fingers range from the scrubbed and perfectly manicured to the very filthy, while tabletops can pick up and transfer many contaminants to the casino chips. The chips become color muted and dirty in a way that reflects badly on the casino. In addition to general hygiene, the possibility of significant disease transmission is a consideration. Players often touch their mouth and other parts of their face, body, and clothing in the process of making a decision, thereby transferring germs and other matter to the chips. With the rising incidence of diseases such as the Norovirus on cruise ships, frequent cleaning and sanitization regimes are rigorously enforced. In view of all this, casino owners, staff, players, and others contacting casino chips all desire ways to alleviate the foregoing concerns.

Replacing used casino chips is expensive and washing them by hand is very time consuming. Some have tried using an automated casino chip washing machine that reduces the time to clean and dry a chip. In one version, for example, the casino chips are conveyed to a vertically oriented carrier wheel having recesses in which the casino chips fit, held by their edges with both faces exposed (see, for example, United States Patent Publication No. 2008/0257388). As the carrier wheel rotates, the casino chips move past a washing station that uses a wash solution and scrub brushes. They do so one chip at a time. In addition, the washing machine fails to scrub the edges of the casino chips. Furthermore, the somewhat strong wash solution and the abrasive action of the scrub brushes may tend to deteriorate the casino chip graphics and impart accelerated wear to the chip to the point where replacement is soon required. Thus, a need exists for a better way to clean casino chips that works quickly and inexpensively without damaging chip graphics and introducing abrasive chip deterioration.

SUMMARY OF THE INVENTION

In view of the foregoing, it is an object of the present invention to respond to the above-described need and alleviate the foregoing concerns. The present invention does so predicated on the inventors' recognition of the problems involved and their conception of an ultrasonic cleaning method and related equipment for cleaning casino chips. The ultrasonic cleaning approach of the invention results in a simple-to-use, fast, efficient, chip-cleaning system having an ultrasonic cleaning station that enables fast, consistent, and thorough cleaning while minimizing graphics damage or abrasive chip deterioration.

To paraphrase some of the more precise language appearing in the claims and further introduce the nomenclature used, the invention provides a method for cleaning casino chips that includes the step of (I) providing an ultrasonic cleaning system having a cleaning station with ultrasonic cleaning means for receiving and ultrasonically cleaning a batch of casino chips. Preferably, the ultrasonic cleaning station includes a rotatable mesh basket in which the batch of casino chips are placed and submersed in a gentle cleaning solution. The method proceeds by (ii) taking the batch of casino chips to be cleaned out of service, and then (iii) cleaning the batch of casino chips at the ultrasonic cleaning station with the ultrasonic cleaning means. Preferably, the method includes following the ultrasonic cleaning with (iv) rinsing the batch of casino chips at a rinsing station, (v) applying an anti-slip coating to the batch of casino chips at a coating station in order to enhance chip stackability, and (vi) drying the batch of casino chips at a drying station. Thereafter, the casino chips are re-racked for re-use.

According to the structural aspect of the invention, a chip-cleaning system constructed according to the invention includes a console (e.g., a six-foot long, waist-high console) having four tanks providing the cleaning stations. The first tank is an ultrasonic cleaning station with ultrasonic cleaning means (e.g., a known type of ultrasonic cleaning component with the rotatable mesh basket mentioned above). The second tank serves as the ultrasonic rinsing station, the third tank serves as the coating station, and the fourth tank serves as the drying station. In addition, a first table-top extension adjacent the ultrasonic cleaning station serves as a chip staging area wing, and a second table-top extension adjacent the chip-drying station serves as a re-racking area wing. Suitable power and control components are included beneath the tanks in a storage section of the unit. Preferably, the console includes means for assisting an operator move a basket of chips between the four stations, with one console embodiment including a moveable basket-counterbalancing mechanical arm assembly for that purpose.

Thus, the invention provides a method and equipment for cleaning casino chips utilizing ultrasonic technology for fast, efficient, and easy chip cleaning. Using ultrasonics facilitates the removal of grime from recesses in the chips and restores overall chip color and sharpness. Bulk quantities of chips can be cleaned and ready to go back to the gaming tables in less than thirty minutes as clean, attractive gaming chips. The following illustrative drawings and detailed description make the foregoing and other objects, features, and advantages of the invention more apparent.

DESCRIPTION OF THE PREFERRED EMBODIMENTS

Figure 1:
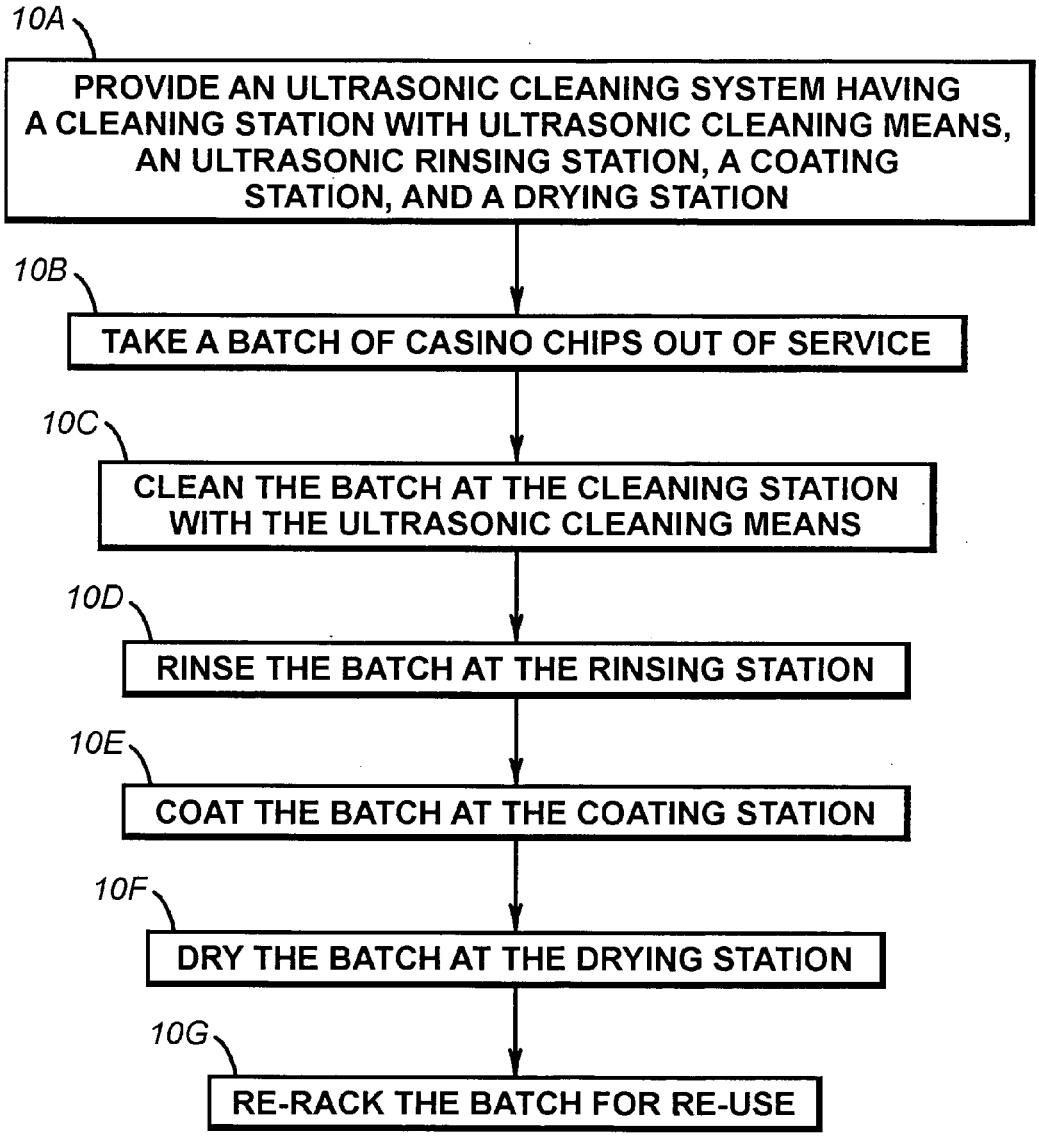
FIG. 1 of the drawings is a flow chart illustrating various steps of the casino chip cleaning method of the present invention.
Figure 2:
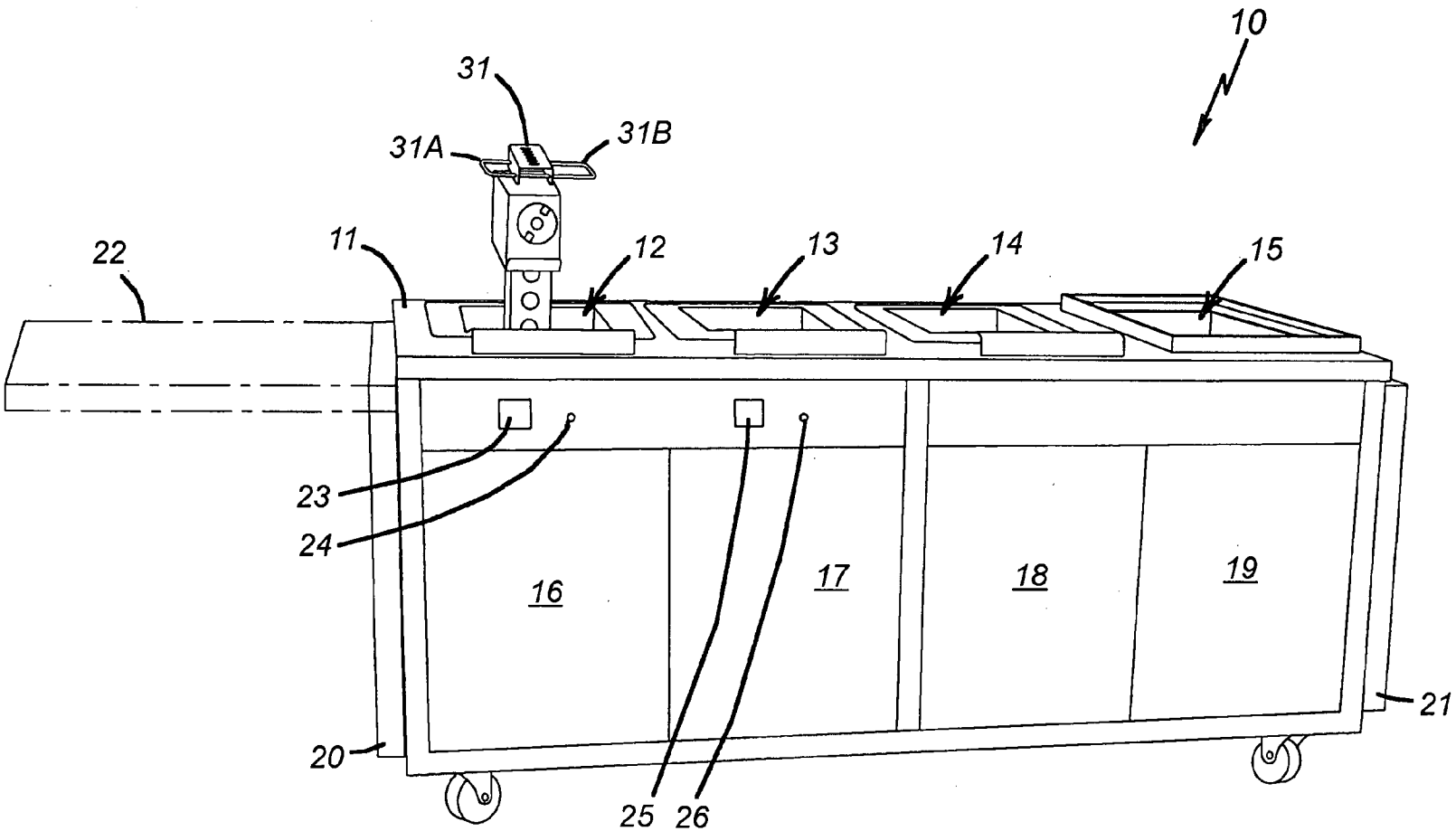
FIG. 2 is a perspective view of the top, front and left side of the four-tank console of an ultrasonic chip-cleaning system constructed according to the invention.
Figure 3:
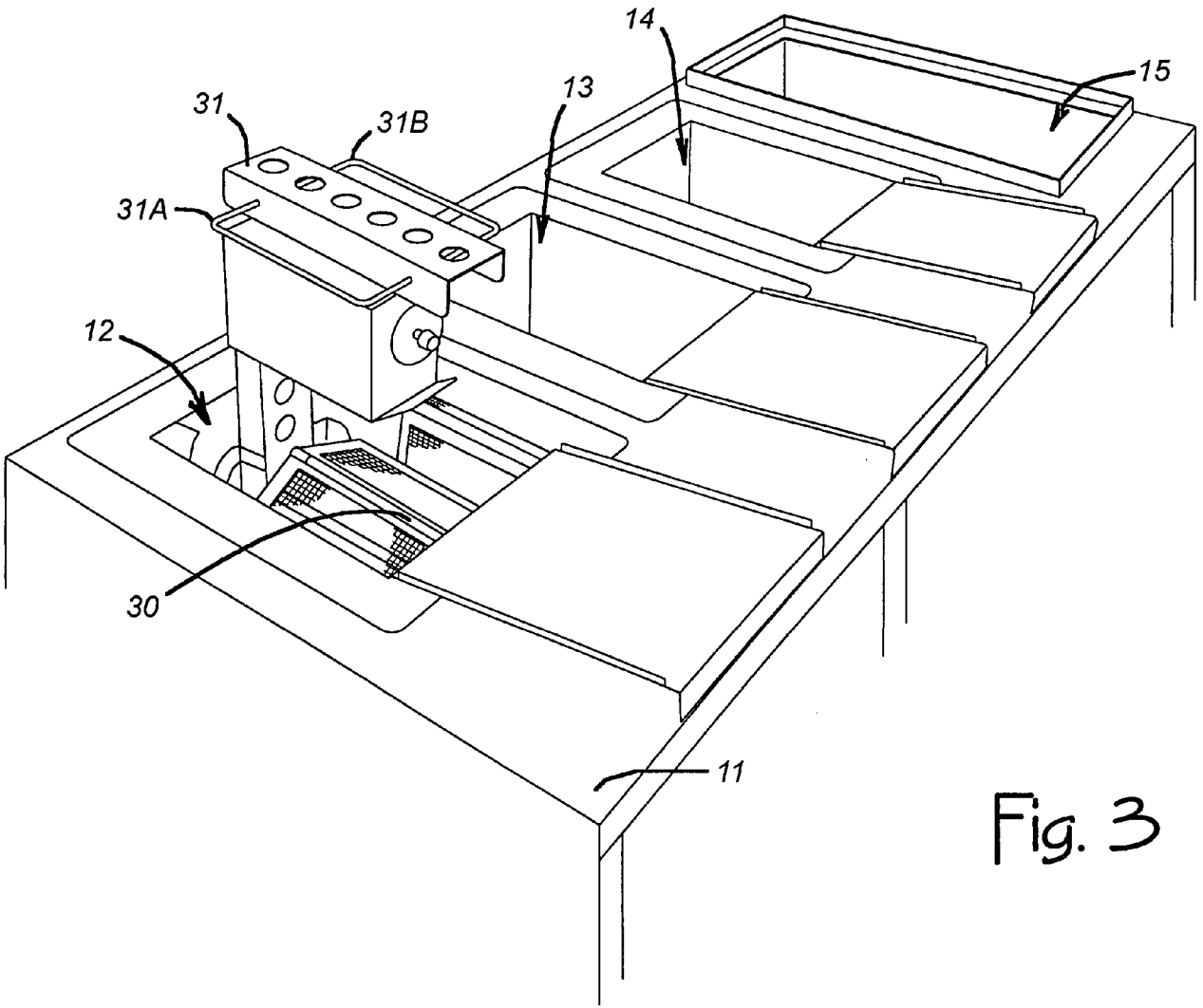
FIG. 3 is an enlarged perspective view of the top view of the console.

FIG. 1 of the drawings shows a flow chart consisting of individual blocks 10A through 10G that illustrate the method of the present invention as used with the equipment of a casino chip cleaning system 10 illustrated in FIGS. 2 though 6. The chip-cleaning method outlined in FIG. 1 includes the step of (I) providing an ultrasonic chip-cleaning system (e.g., the system 10) having a console 11 with a cleaning station 12, a rinsing station 13, a coating station 14, and a drying station 15 (FIGS. 2 and 3). The cleaning station 12 includes ultrasonic cleaning means for cleaning chips, and the method proceeds by (ii) taking a batch of casino chips out of service (block 10B) and (iii) cleaning that batch of casino chips at the cleaning station 12 with the ultrasonic cleaning means (block 10C). Thereafter, the method includes the steps of (iv) rinsing the batch of casino chips at the ultrasonic rinsing station 13 (block 10D), coating the batch of casino chips at the coating station 14, drying the batch of casino chips at the drying station 15, and re-racking the batch of casino chips for re-use. Those steps are further explained subsequently with reference to the system 10 in FIGS. 2-6.

Figure 5:
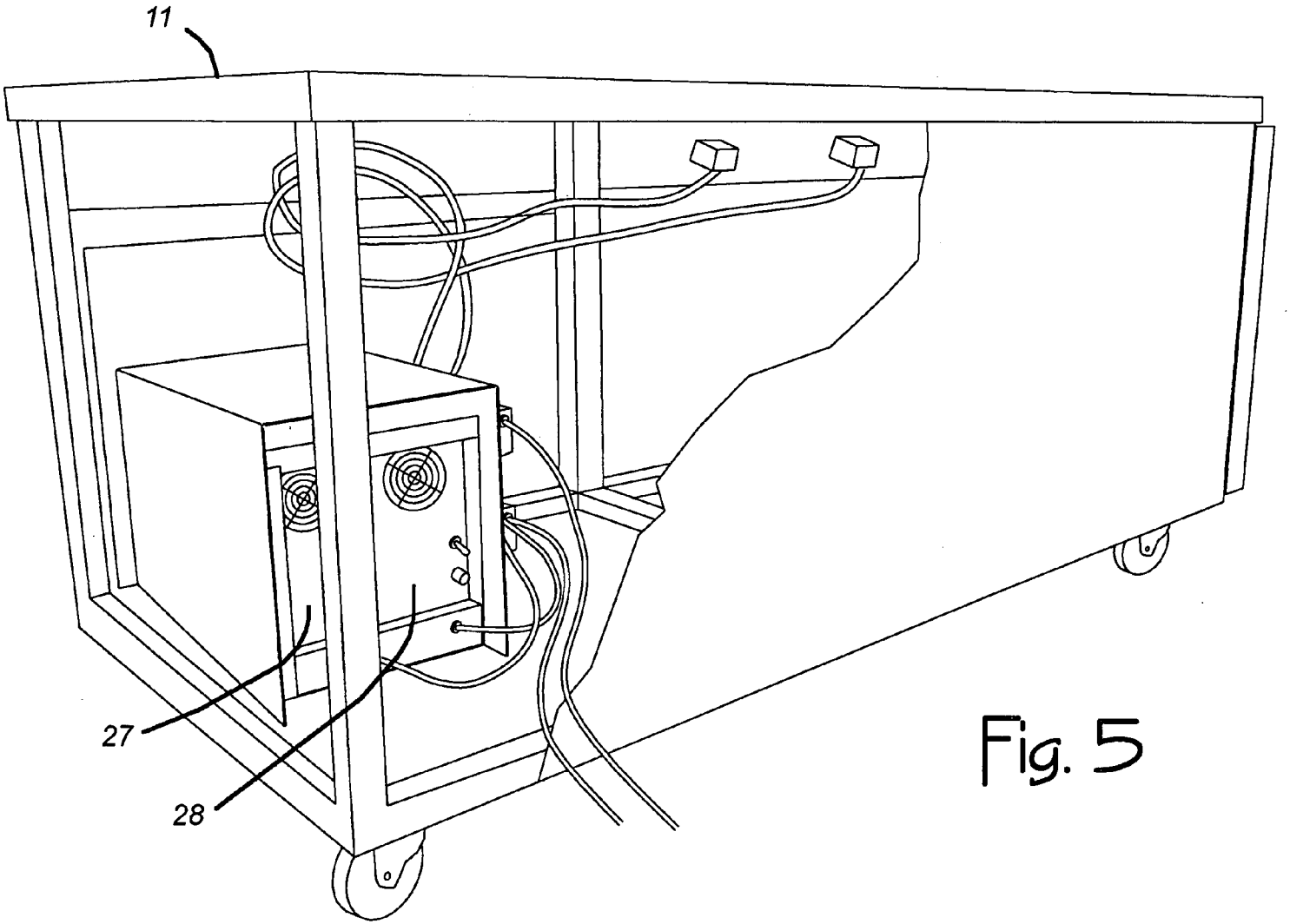
FIG. 5 is a perspective view of the back and right side of the unit, with the second table-top extension omitted for illustrative purposes.
Figure 6:
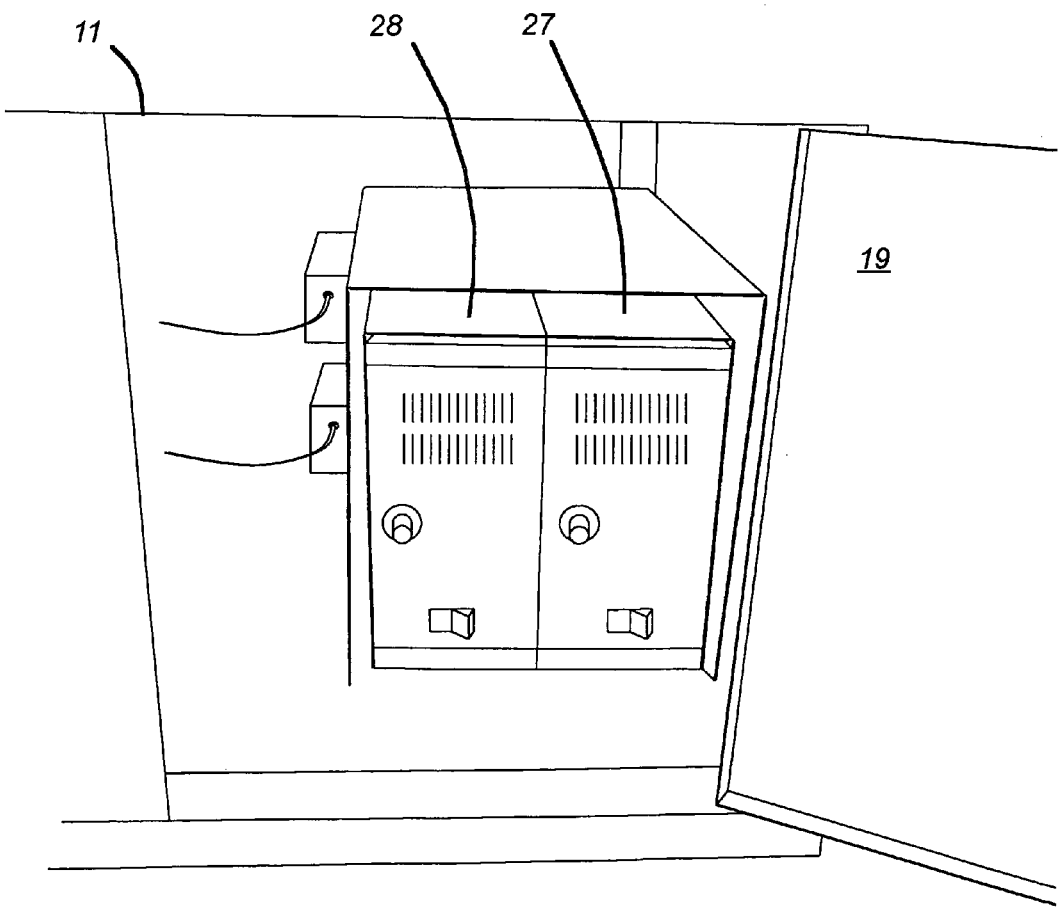
FIG. 6 is an enlarged view of the ultrasonic power generating components.

The illustrated console 11 (FIGS. 2 and 3) takes the form of a 6-foot long steel frame supported on four casters. It includes the four tank structures 12, 13, 14, and 15, along with front panel doors 16, 17, 18, and 19 (FIG. 1), and first and second foldable extensions 20 and 21 that lift into working positions at opposite ends of the console (the working position of the first foldable extension is shown in FIG. 1 at reference numeral 22). Four physically separated stations can be provided instead of an integrated unit within the broader inventive concepts disclosed (i.e., each station a separate unit). A forwardly facing panel ahead of the cleaning and rinsing tanks includes ultrasonic controls 23 and 24 for the first tank and 25 and 26 for the second tank that enables a user to operate the ultrasonics for a desired duration of ultrasonic cleaning and ultrasonic rinsing (e.g., typically in a range of one to six minutes for each station). Two ultrasonic power generating units 27 and 28, each for a respective one of the first and second tanks, are provided in the storage space beneath the fourth tank (FIGS. 5 and 6).

Figure 4:
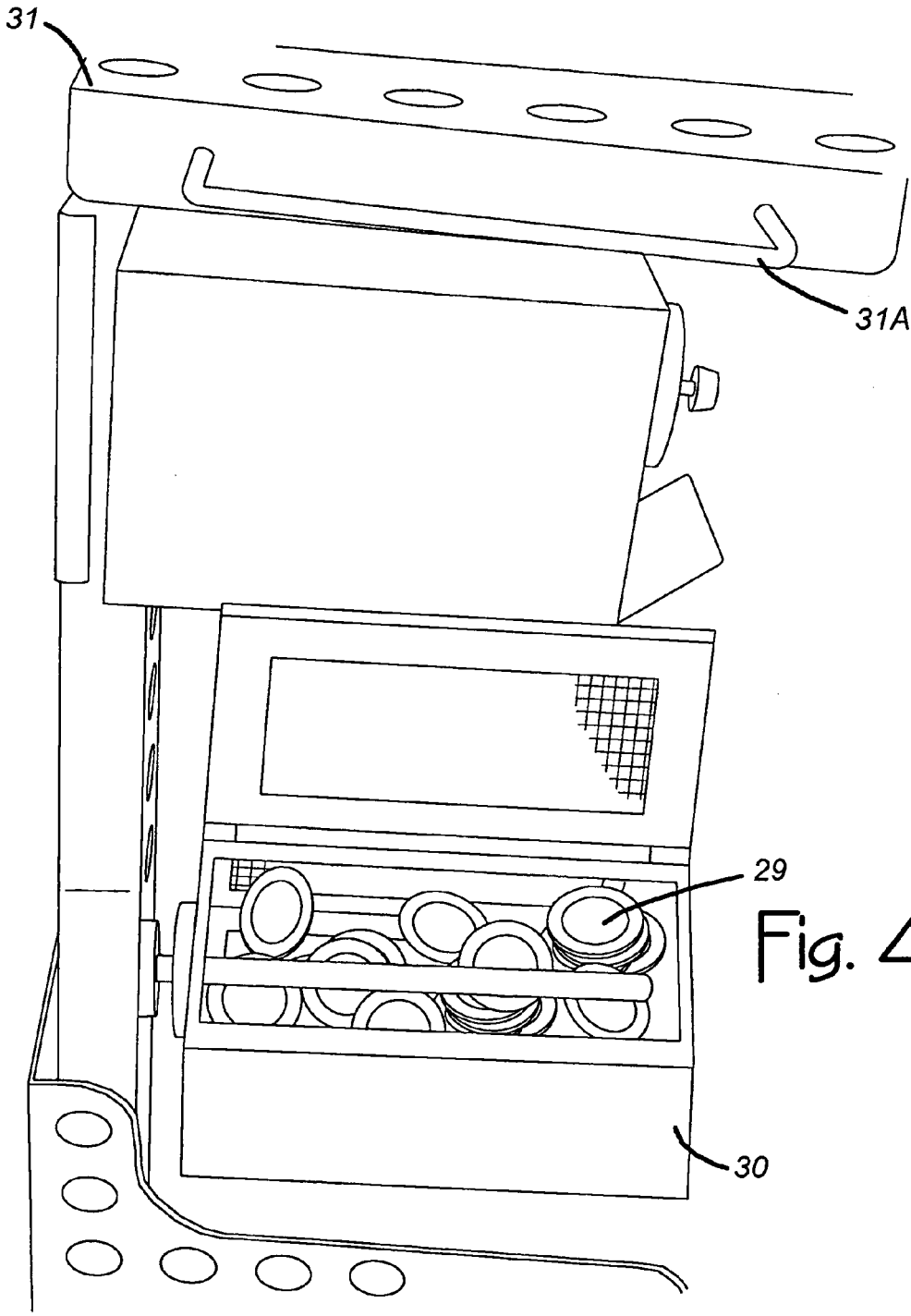
FIG. 4 is an enlarged view of the ultrasonic cleaning component that a user submerges in solution in the first tank.

With the foldable table-top extensions 20 and 21 deployed in their upward positions (only the first table-top extension 20 being illustrated that way at numeral 22), a batch 29 of casino chips to be cleaned, that has been taken out of service, is placed atop the first foldable table-top extension 20 where the batch 29 of casino chips are transferred from the racks in which they are held (not shown) to a rotatable basket 30 component of a motor-powered rotatable basket assembly 31 (RBA) that is illustrated in FIG. 4. The user places that basket assembly 31 removably into the first tank 12, in the position shown in FIGS. 2 and 3. The rotatable basket 30 is large enough to hold about 300 to 400 casino chips so that all the chips are submerged in a mild solution that the user adds to the first tank 12 before energizing the ultrasonic cleaning component by operation of the front panel controls. The ultrasonic cleaning unit 27 is energized for a selected duration, and that results in cleaned casino chips.

Ultrasonic energy (i.e., sound waves) is produced in a known way by high frequency electrical energy coupled to piezoelectric transducers mounted on the bases of the first and second stainless steel tanks at the cleaning and rinsing stations 12 and 13. In the liquid bath contained in those tanks, millions of microscopic bubbles are formed by the ultrasonic sound waves. The bubbles expand and contract, creating a phenomenon known as "cavitation." The energy generated through this cavitation propels the bubbles against items submersed in the liquid. The bubbles act as tiny, high-speed brushes that move into any tiny crevices and recesses. Using this ultrasonic cavitation energy and a cleaning surfactant, dirt and grime are rapidly knocked free from the submersed casino chips. One of ordinary skill in the art can readily choose and use any of various known mild cleaning solutions formulated with anti-foaming properties, including the solution commercially available under the trademark CHIP BRITE CLEANING SOLUTION CB-Z1 from Specific Solutions Company of Temecula, Calif.

After the ultrasonic cleaning step, the user lifts the rotatable basket assembly 31, by handles 31A and 31B provided for that purpose, and moves it to rest on the drain-back surface (i.e., a surface next to the tank from which liquid drains back into the tank). Then, the user moves basket assembly 31 to the second tank at the rinsing station 13 for ultrasonic rinsing of the cleaned casino chips in clear water or other suitable rinsing fluid for a selected duration (with the basket 30 rotating). Doing so results in cleaned and rinsed casino chips.

Next, the rotatable basket assembly 31 is moved to the drain-back position, then to the third tank at the coating station 14 where the cleaned and rinsed casino chips are submersed in a stackability-enhancing solution for a period of time in a range of about one to five minutes (with the basket rotating). The stackability-enhancing solution counteracts the thin, slippery film imparted by the surfactants in the cleaning solution used in the first tank (the cleaning station 12). It is a polymer solution that deposits a very thin layer on the chip, thereby increasing the coefficient of friction between stacked chips. Absent a suitable stackability-enhancing coating, cleaned and rinsed chips tend to slide relative to each other so that stacking them is difficult. One of ordinary skill in the art can readily choose and use any of various known solutions to counteract the cleaning solution surfactants, including the solution commercially available under the trademark LUSTER L6 from Specific Solutions Company of Temecula, Calif.

After coating the cleaned and rinsed casino chips that way, the assembly 31 is removed from the drain-back position, then to the third tank where the resulting cleaned, rinsed, and coated casino chips are placed into the fourth tank at the drying station 15 for drying. Absorbent towels placed in the fourth tank ahead of the chips help the drying effort. Forced air drying may be employed too. Thereafter, the cleaned, rinsed, coated, and dried casino chips are moved to the second foldable table-top extension 21 where they are re-racked for re-use at the gaming tables.

With further regard to the rotatable basket assembly 31, one version with a 7.0-inch diameter holds about 300 chips or so. Fully loaded, it weighs about 29 pounds. As a result, the assembly 31 filled with chips can be somewhat heavy for an operator to lift and move between the four tanks 12, 13, 14, and 15. A larger version of the basket assembly 31 with an 8.5-inch diameter holds about 500 chips or so and weighs about 35 pounds. It is even heavier for the operator to lift and move. Thus, a better way to transport a batch of chips between stations was desirable.

FIGS. 7, 8, 9, and 10 show a second system 100 having a second console embodiment, designated as a console 111 that is designed to address the above-described issue. The system 100 and the console 111 are generally similar to the system 10 and console 11, and so only major differences are described in further detail. For convenience, reference numerals designating parts of the system 100 are increased by one hundred over those designating, similar, related, or associated parts of the system 10.

Figure 7:
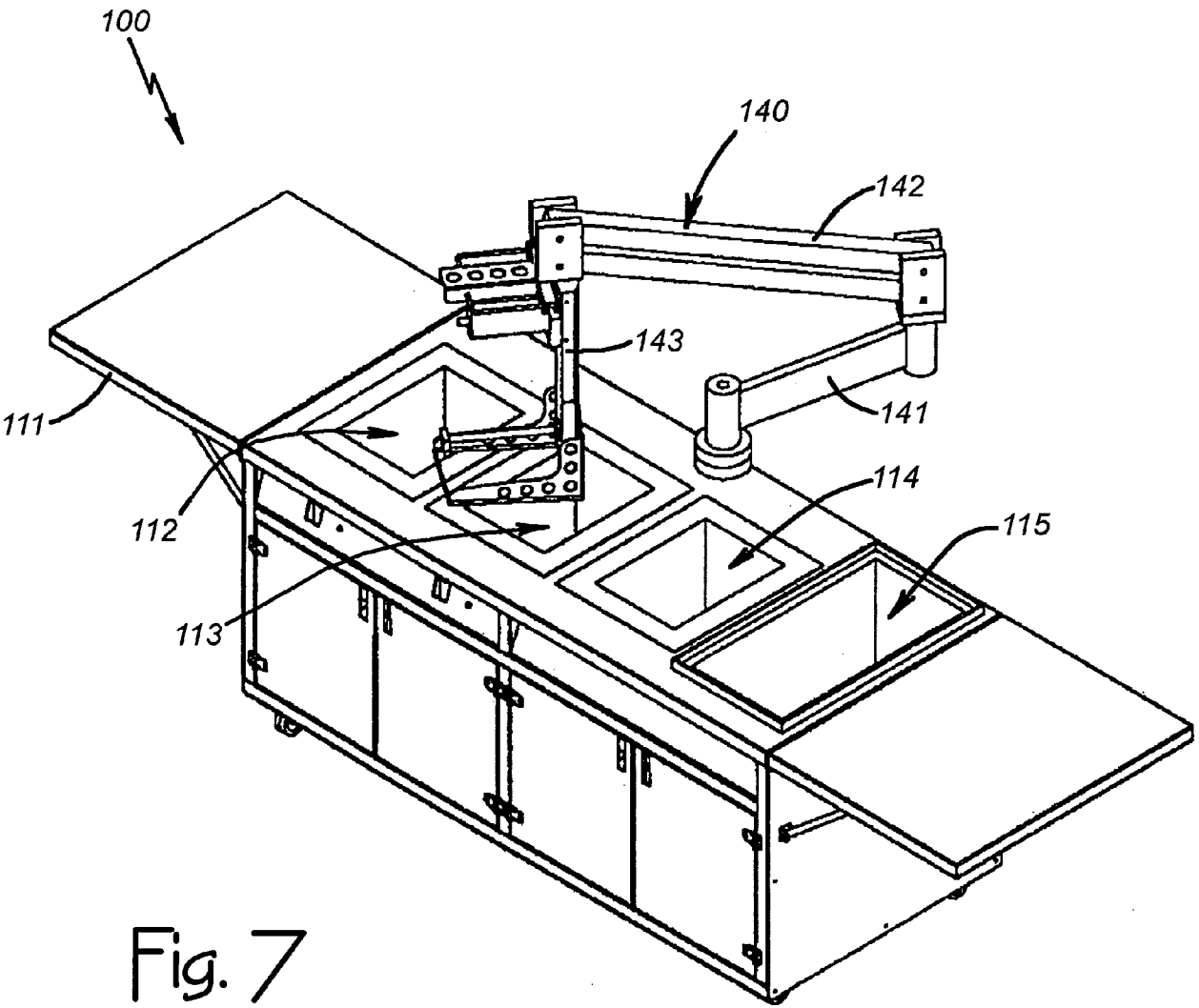
FIG. 7 is a perspective view of a second console embodiment that includes a mechanical basket-counterbalancing arm assembly.
Figure 8:
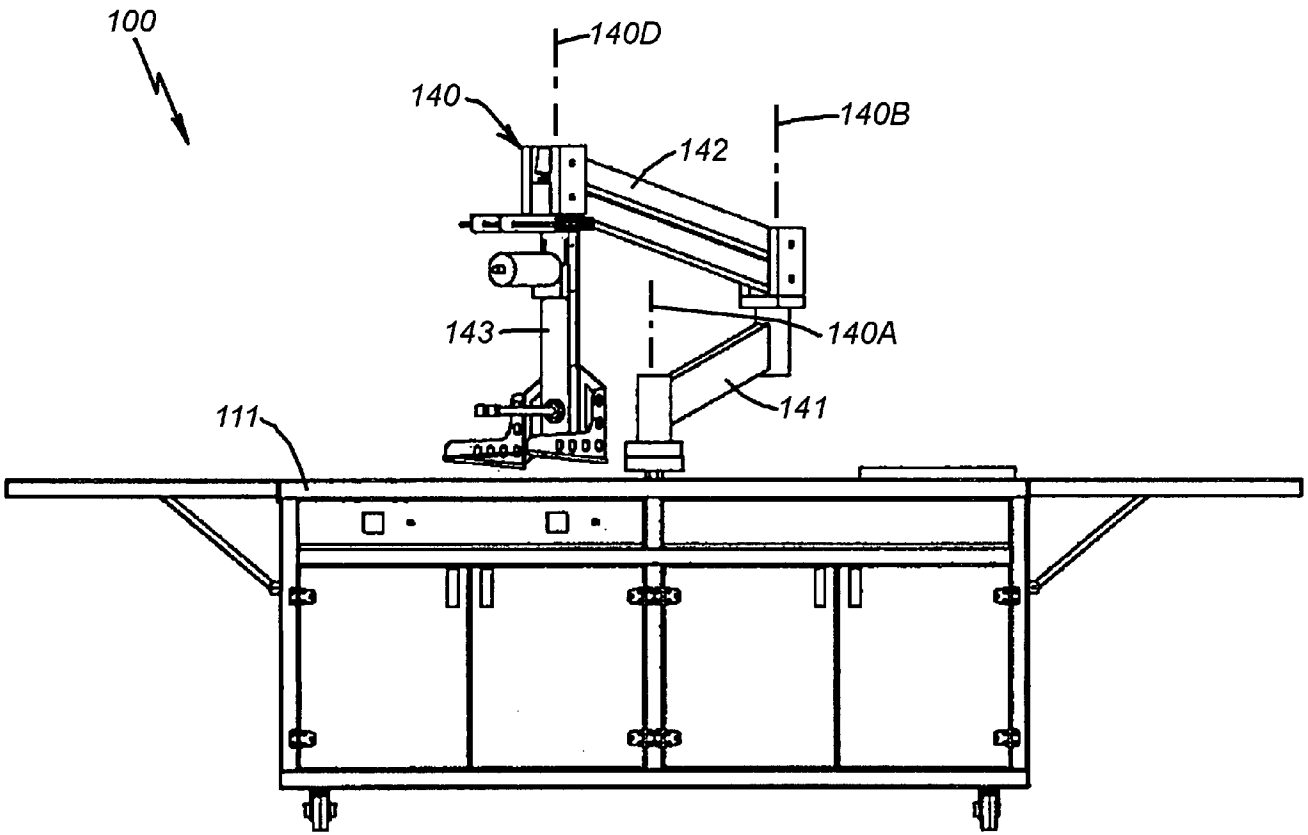
FIG. 8 is a front elevation view of the second console embodiment.
Figure 9:
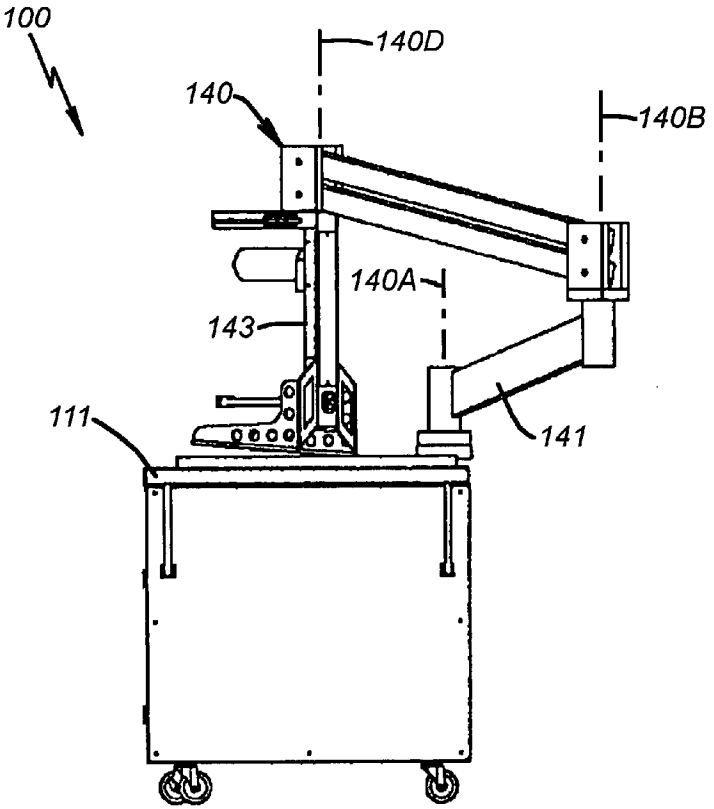
FIG. 9 is a side elevation view of the second console embodiment.

Similar to the console 11, the console 111 includes four tank structures 112, 113, 114, and 115 (FIG. 7). They serve as a cleaning station 112, a rinsing station 113, a coating station 114, and a drying station 115. The console 111 also includes a motor-powered rotatable basket assembly 31 for transporting a batch of chips between the four stations. The basket assembly 31 is not shown in FIGS. 7-10 for illustrative convenience. The major difference in the system 100 is that it includes a mechanical arm assembly 140 for lifting and moving the basket assembly 31 between the tank structures 112-115. It is also referred to as a flex arm lift assist (FALA). The mechanical arm assembly 140 extends about 32 inches above the tank structures and it counterbalances the basket assembly full of chips. The illustrated mechanical arm assembly 140 is fully mechanical in that it uses counterbalance gas shocks (e.g., like those on the tailgate of a sport utility vehicle). Stated another way, the console 111 includes means for assisting an operator move a basket of chips between the four stations, with one console embodiment including the moveable basket-counterbalancing mechanical arm assembly 140 for that purpose.

Figure 10:
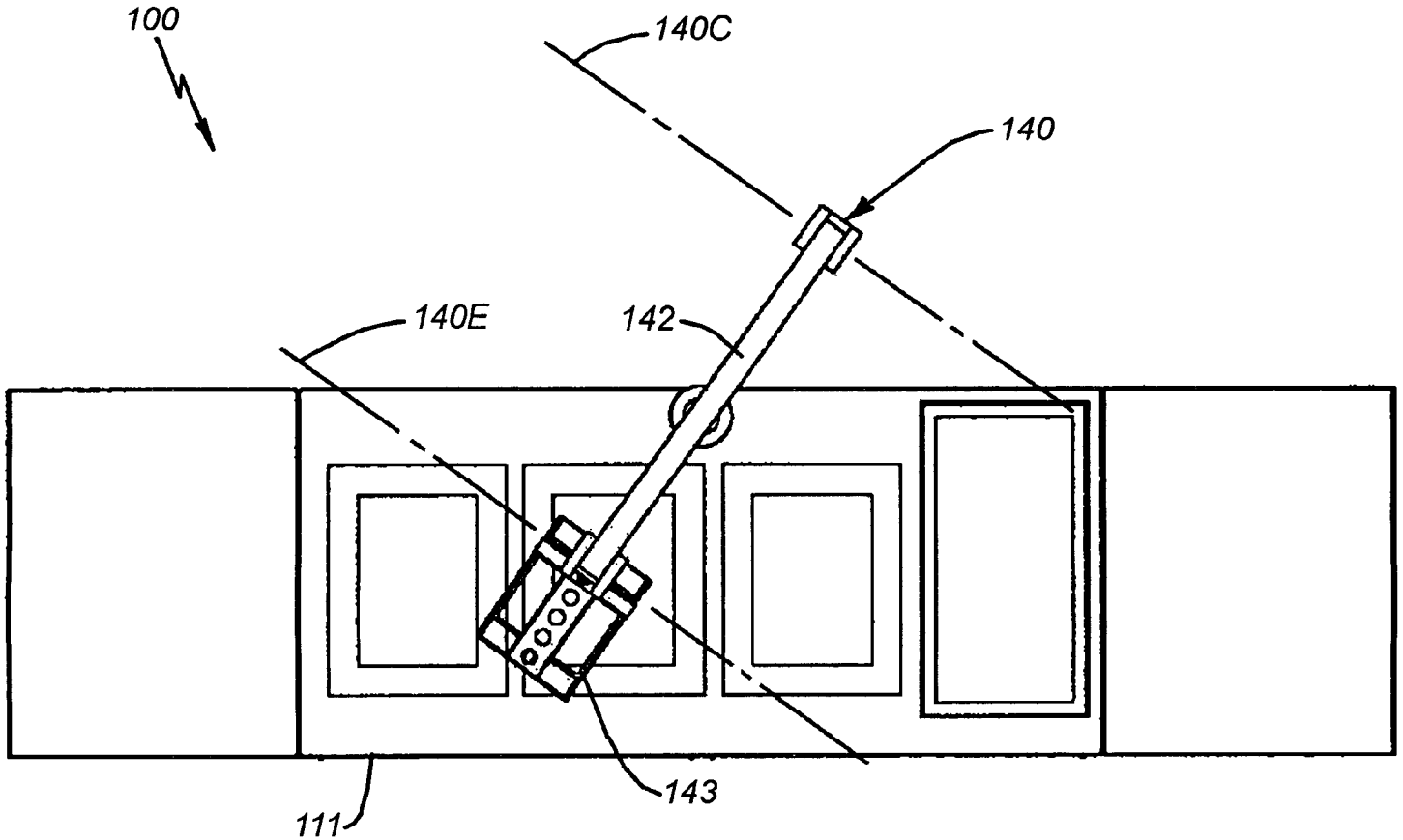
FIG. 10 is a top plan view of the second console embodiment.

The mechanical arm assembly 140 includes a first arm subassembly 141 mounted rotatably on the console 111, a dual-member second arm subassembly 142 mounted rotatably on the first arm subassembly 141, and a basket-holding subassembly 143 mounted rotatably on the dual-member second arm subassembly 142, with the dual members maintaining a vertical orientation for the basket-holding subassembly 143. The operator can pivot the first arm subassembly 141 relative to the console 111 about a vertically disposed first axis of rotation 140A. They can pivot the second arm subassembly 142 relative to the first arm subassembly 141 about a vertically disposed second axis of rotation 140B (FIGS. 8 and 9) and about a horizontally disposed third axis of rotation 140C (FIG. 10). They can also pivot the basket-holding subassembly 143 relative to the second arm subassembly 142 about a vertically disposed fourth axis of rotation 140D (FIGS. 8 and 9) and about a horizontally disposed fifth axis of rotation 140E (FIG. 10). Those several degrees of freedom enable the desired counterbalanced movement of the basket assembly 31 between all four stations 112, 113, 114, and 115. Use of the mechanical arm assembly 140 makes it unnecessary to use drain-back surfaces; instead, the operator uses the mechanical arm assembly 140 to hold the basket assembly 31 above a tank structure for drainage. Based upon the foregoing, one of ordinary skill in the art can readily implement a console with a counterbalance arm assembly according to the invention.

Thus, predicated on the inventors' recognition of the problems involved and their conception of an ultrasonic cleaning method and related equipment for cleaning casino chips, the ultrasonic cleaning approach of the invention results in a simple-to-use, fast, efficient, chip-cleaning system having an ultrasonic cleaning station that enables fast, consistent, and thorough cleaning without graphics damage or abrasive chip deterioration. Although an exemplary embodiment has been shown and described, one of ordinary skill in the art may make many changes, modifications, and substitutions without necessarily departing from the spirit and scope of the invention. As for the specific terminology used to describe the exemplary embodiment, it is not intended to limit the invention; each specific term is intended to include all technical equivalents that operate in a similar manner to accomplish a similar purpose or function. The term "chips" and "casino chips" herein, for example, include gaming chips, tokens (including slot machine tokens), checks, and cheques. Taking the chips "out of service" includes discontinuing use for purposes of cleaning the chips. "Station" includes a group of components that functions as means for performing one of the method steps, including, for example, a structure defining a tank.

What is claimed is:

1. A method for cleaning casino chips, comprising:

providing a chip-cleaning system having an ultrasonic cleaning station with ultrasonic cleaning means;

taking a batch of casino chips to be cleaned out of service; and cleaning the batch of casino chips at the ultrasonic cleaning station with the ultrasonic cleaning means;

wherein the step of providing a chip-cleaning system includes providing a chip-cleaning system having an ultrasonic cleaning station with ultrasonic cleaning means, a rinsing station, a coating station, and a drying station; and wherein the method further comprises rinsing the batch of casino chips at the rinsing station, coating the batch of casino chips at the coating station with a stackability-enhancing substance, and drying the batch of casino chips at the drying station.

* * * * *